US008230829B2

(12) United States Patent
Sundsten et al.

(10) Patent No.: US 8,230,829 B2
(45) Date of Patent: Jul. 31, 2012

(54) CONTROL ARRANGEMENT FOR A GAS EXCHANGE VALVE IN A PISTON ENGINE AND METHOD OF CONTROLLING A GAS EXCHANGE VALVE IN A PISTON ENGINE

(75) Inventors: Magnus Sundsten, Korsholm (FI); Saku Niinikangas, Vaasa (FI); Jussi Autio, Vaasa (FI)

(73) Assignee: Wärtsilä Finland Oy, Vaasa (FI)

( * ) Notice: Subject to any disclaimer, the term of this patent is extended or adjusted under 35 U.S.C. 154(b) by 382 days.

(21) Appl. No.: 12/306,755

(22) PCT Filed: Jun. 6, 2007

(86) PCT No.: PCT/FI2007/050332

§ 371 (c)(1),
(2), (4) Date: Dec. 29, 2008

(87) PCT Pub. No.: WO2008/000899

PCT Pub. Date: Jan. 3, 2008

(65) Prior Publication Data

US 2009/0320780 A1 Dec. 31, 2009

(30) Foreign Application Priority Data

Jun. 30, 2006 (FI) ..... 20065460

(51) Int. Cl.
*F01L 9/02* (2006.01)

(52) U.S. Cl. ..... 123/90.12; 123/90.13; 137/455

(58) Field of Classification Search ..... 123/90.12, 123/90.13, 90.55, 90.56; 137/455
See application file for complete search history.

(56) References Cited

U.S. PATENT DOCUMENTS

| | | | | |
|---|---|---|---|---|
| 6,321,706 | B1 | 11/2001 | Wing | |
| 6,341,585 | B1 | 1/2002 | Warren | |
| 7,004,122 | B2 * | 2/2006 | Cornell et al. | 123/90.12 |
| 2005/0120986 | A1 | 6/2005 | Tai et al. | |

FOREIGN PATENT DOCUMENTS

| | | | |
|---|---|---|---|
| DE | 3833459 | | 4/1990 |
| DE | 4202542 | | 8/1992 |
| DE | 4427271 | | 2/1995 |
| DE | 4443169 | A1 | 6/1996 |
| JP | 07026922 | | 1/1995 |
| JP | 2005233031 | A | 9/2005 |
| JP | 2006152943 | A | 6/2006 |
| WO | 03067036 | A | 8/2003 |

OTHER PUBLICATIONS

Second Office Action for CN200780024582.5, Jun. 27, 2011.
Makoto Yagi, Japanese Office action for JP 2009-517302, Aug. 2, 2011.

* cited by examiner

*Primary Examiner* — Ching Chang
(74) *Attorney, Agent, or Firm* — Chernoff, Vilhauer, McClung & Stenzel, LLP

(57) ABSTRACT

A control arrangement for a gas exchange valve in a piston engine adapted between the camshaft of the engine and the valve mechanism, which control arrangement comprises a body part and a chamber arranged therein, into which chamber a connection for hydraulic medium opens and in which a piston device is arranged in force transmission connection with the camshaft and the valve mechanism. The connection for hydraulic medium opens to a space in the chamber, which space increases as the piston device moves in the opening direction of the valve, whereby hydraulic medium is arranged to flow into the space, when the valve is being opened, and out of the space, when the valve is being closed.

12 Claims, 4 Drawing Sheets

CONTROL ARRANGEMENT FOR A GAS EXCHANGE VALVE IN A PISTON ENGINE AND METHOD OF CONTROLLING A GAS EXCHANGE VALVE IN A PISTON ENGINE

This is a national stage application filed under 35 USC 371 based on International Application No. PCT/FI2007/050332 filed Jun. 6, 2007, and claims priority under 35 USC 119 of Finnish Patent Application No. 20065460 filed Jun. 30, 2006.

The present invention relates to a control arrangement for a gas exchange valve in a piston engine, which control arrangement is adapted between the camshaft of the engine and the valve mechanism and comprises a body part and a chamber arranged therein, into which chamber a connection for hydraulic medium opens and in which a piston device is arranged in force transmission connection with the camshaft and the valve mechanism.

From FI 101166 it is previously known to use hydraulic medium to control the closing of a gas exchange valve of a piston engine. By the solution according to the publication it is not, however, possible to delay the closing of the valve, which would provide the benefit of getting more air into the cylinder.

In order to minimise emissions from a diesel engine the timing of the inlet valves needs to be such that the valve is closed early before the bottom dead centre of the piston, while the boost pressure is raised accordingly so as to get a sufficient amount of air to the cylinder. This kind of arrangement is, however, problematic with low engine loads, when the boost pressure of the turbocharger is still relatively low.

A purpose of the invention is to provide a control arrangement for a gas exchange valve in a piston engine minimising the problems related to prior art.

The objects of the invention are primarily achieved as disclosed in the appended claims 1 and 7, and more closely as explained in the other claims.

The control arrangement for a gas exchange valve in a piston engine according to the invention is adapted between the camshaft of the engine and the valve mechanism and comprises a body part and a chamber arranged therein, into which chamber a connection for hydraulic medium opens and in which a piston device is arranged in force transmission connection with the camshaft and the valve mechanism. The invention is characterised in that the connection for hydraulic medium opens to a space in the chamber, which space increases as the piston device moves in the opening direction of the valve, whereby hydraulic medium is arranged to flow into the space, when the valve is being opened, and out of the space, when the valve is being closed. In this way it is possible to act simply and effectively on the speed of the return movement of the piston device, and also on the start thereof, by controlling the discharge of hydraulic medium from the chamber space. The ends of the space are defined by a first portion of the piston device and a partition wall in the chamber, and the sides thereof are defined by the body part and a second portion of the piston device.

According to one embodiment the connection for hydraulic medium comprises separately a feed conduit and a discharge conduit for hydraulic medium. When the discharge conduit comprises a flow throttling device, the adjustability of the operation of the control arrangement can be improved considerably. The throttling device also comprises a control device for throttling effect.

According to one embodiment the piston device is in force transmission connection with the camshaft via a guide portion and the discharge conduit is provided with a valve device, the operational mode of which is dependent on the position of the guide portion with respect to the body part. Thus the control of the flow of hydraulic medium is made dependent on the operational mode of the engine and the discharge of hydraulic medium from the chamber space is affected more efficiently.

According to one embodiment a space parallel with the chamber is arranged in the body part, and a guide member is arranged in the space to follow the movement of the guide portion by means of compression force provided by a spring and guided by the cam profile, which guide member is provided with a flow path for discharging hydraulic medium from the chamber space. Also in this embodiment the discharge of hydraulic medium is dependent on the position of the guide portion with respect to the body part.

In the method according to the invention of controlling a gas exchange valve in a piston engine by a control arrangement for a gas exchange valve in a piston engine, which control arrangement is adapted between the camshaft of the engine and the valve mechanism and comprises a body part and a space arranged therein, into which space a connection for hydraulic medium opens and in which a piston device is arranged in force transmission connection with the camshaft and the valve mechanism, the flowing of hydraulic medium into said space during the opening phase of the valve is allowed and during the closing phase of the valve the flowing of hydraulic medium out of the space is throttled, whereby the closing of the valve is slowed down. The outflow of hydraulic medium from the space is throttled before or at the same time as the hydraulic medium flows away from the control arrangement.

For instance following advantages are achieved by the present invention. The invention makes it possible to improve the optimising of the engine performance for a wide load and revolution range. The arrangement according to the invention is relatively simple and thus reliable.

In the following, the invention is explained in more detail, by way of example, with reference to the appended schematic drawings, in which FIG. 1 shows a piston engine and a skeleton diagram of its valve mechanism;

Figure 1:
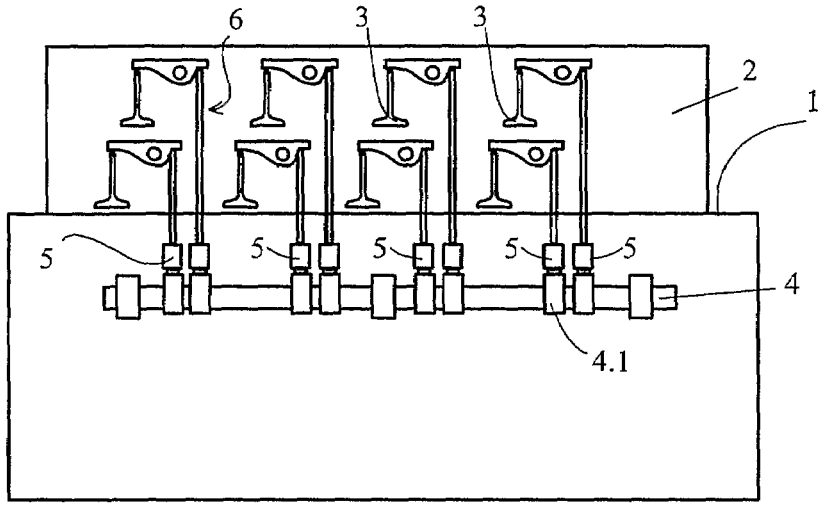

FIG. 1 shows a schematic view of a piston engine 1 as far it is relevant to the understanding of the invention. The gas exchange of the cylinders (not shown) in the piston engine 1 is carried out under the control of valves 3 located on a cylinder block 2. The valves 3 operate through a mechanism and are typically driven by the camshaft 4 of the engine and guided by cam profiles 4.1. The force transmission connection between each valve mechanism 6 is realised by a control arrangement 5.

Figure 2:
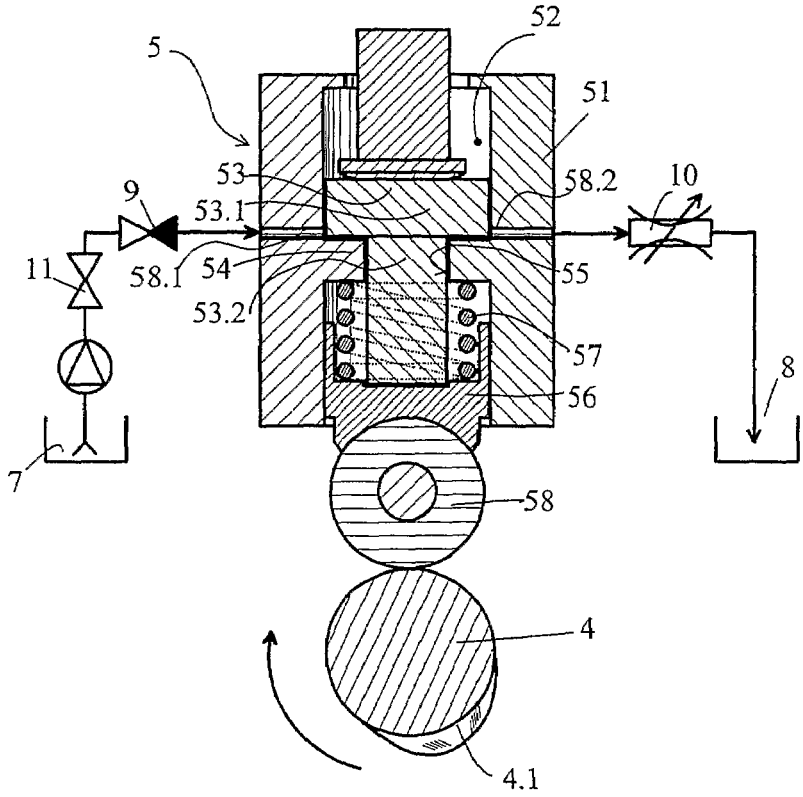
FIG. 2 shows a control arrangement according to the invention in an unoperated state.
Figure 3:
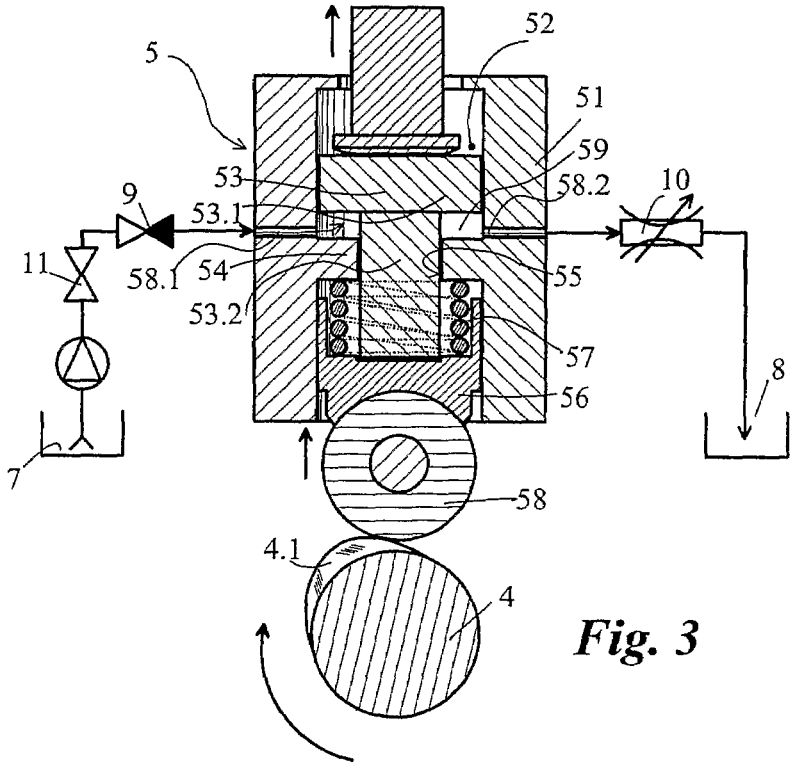
FIG. 3 shows a control arrangement according to the invention during the opening phase.
Figure 4:
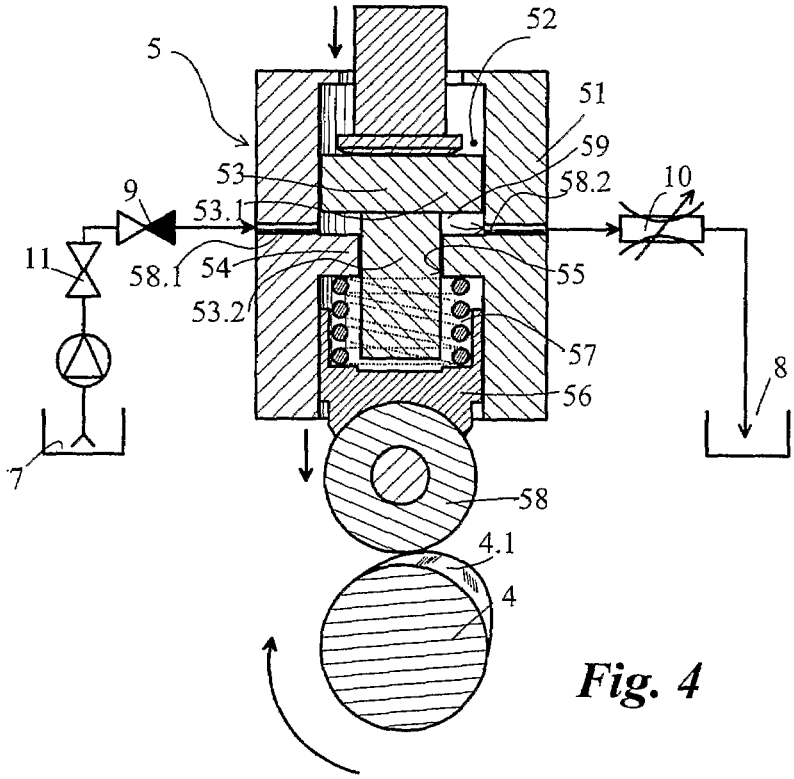
FIG. 4 shows a control arrangement according to the invention during the closing phase.

The control arrangement 5 is shown in more detail in FIGS. 2-4, of which FIG. 2 shows it in an unoperated state, whereby the gas exchange valve in connection therewith is closed. The control arrangement 5 comprises a body part 51, which is typically attached to the engine body. The body part 51 is provided with a chamber 52, in which a piston device 53 is arranged on the first side. The chamber 52 is made cylindrical and the piston device is arranged in the chamber by a relatively tight fit. The piston device 53 is, nevertheless, movable within the cylinder in the direction of its longitudinal axis. The intermediate part of the chamber 52 is provided with a partition wall 54 with a cylindrical opening 55 arranged at the middle axis of the chamber. The piston device comprises a first portion 53.1, the diameter of which corresponds to the diameter of the chamber 52, and a second portion 53.2, which corresponds to the diameter of the opening 55 in the partition wall being smaller than the diameter of the chamber. The second portion 53.2 of the piston device extends in the body part 51 through the opening 55 into the chamber on the other side of the partition wall 54. The thickness of the partition wall in the direction of the longitudinal axis of the piston device is so large here that its surface also operates as an element guiding the movement of the second portion 53.2 of the piston device. The purpose of the partition wall dividing the chamber 52, together with the first portion 53.1 of the piston device, is to provide on the first side of the chamber a space 59, which is defined by both the partition wall and the first portion of the piston device, and the volume of which increases as the piston device moves in the opening direction of the valve, i.e. away from the camshaft 4. In other words, in the longitudinal direction in the figures, the ends of the space 59 are defined by the first portion 53.1 of the piston device 53 and the partition wall 54, and the sides thereof are defined by the body part 51 and the second portion of the piston device.

On the other side of the partition wall 54 in the chamber 52 there is arranged a guide portion 56 as well as a spring 57. Moreover, the guide portion is provided with a roller 58, which moves along the cam profile 4.1, while the camshaft rotates. The spring 57 is adapted between the guide portion 56 and the partition wall 54 to press the guide portion towards the camshaft 4 and to keep the roller 58 in contact with the cam profile 4.1 of the camshaft. On the first side of the chamber 52, in the immediate vicinity of the partition wall 54, there is arranged a connection 58.1, 58.2 for hydraulic medium, which opens to the space 59 in the chamber, which space increases as the piston device moves in the opening direction of the valve. The flow resistance of the hydraulic medium in the connection for hydraulic medium is arranged so that it is lower, while the hydraulic medium is flowing into the space, than the flow resistance, while the hydraulic medium is flowing out of the space. FIGS. 2-4 show an embodiment, in which the connection comprises separately a feed conduit 58.1 and a discharge conduit 58.2. The feed conduit 58.1 is in connection with a source 7 of hydraulic medium, which in an engine may also be a normal forced lubrication system. The discharge conduit 58.2, instead, is in connection with a return system 8 for hydraulic medium, which at simplest may be realised so that the discharge conduit opens to the inner space of the engine, whereby the lubricating oil used as a hydraulic medium is allowed to flow down to the oil sump of the engine. In conjunction with the feed conduit there is arranged a shut-off valve 11 and a one-way directional valve 9 and in conjunction with the discharge conduit 58.2 an adjustable throttling 10. By means of the shut-off valve 11 the feed conduit 58.1 may be connected to the chamber space or disconnected therefrom, depending on whether the aim is to use the arrangement and the delayed closing of the valve according to the invention or not. Owing to the one-way directional valve the control arrangement does not cause any pulsations in the source of hydraulic medium. This is of special importance when lubricating oil is used as a hydraulic medium.

FIG. 3 illustrates a situation, in which the cam profile 4.1 of the camshaft 4 has already started the lift of the piston engine 53, whereby also the engine valve has opened. Hydraulic medium, such as lubricating oil, flows from the source 7 of hydraulic medium through the one-way directional valve into the chamber 52, i.e. to its space 59, the volume of which increases as the piston device moves in the opening direction of the valve, in other words below the piston. Then, the valve opens, determined by the shape of the cam profile 4.1, and simultaneously the chamber space 59 is filled with hydraulic medium. Thus, it is to be noted that the opening phase of the valve is actuated by an entirely mechanical force transmission connection and the effect of the hydraulic medium will not become apparent until the closing phase. After the cam profile 4.1 has exceeded its peak, while the camshaft is rotating, the direction of movement of the piston device 53 changes. In FIG. 3 the piston device has moved upwards, whereas in FIG. 4 the direction of movement changes downwards, i.e. toward the camshaft 4. Now the chamber space 59 contains hydraulic medium and the discharge thereof from the chamber space 59 affects the speed of the movement of the piston device and consequently also the closing of the gas exchange valve. This embodiment includes an adjustable throttling 10 in conjunction with the discharge conduit 58.2, by which throttling a desired time may be set for the flow of the hydraulic medium out of the chamber space 59 and at the same time, a delay for the closing of the valve. At this stage the guide portion 56 follows the cam profile 4.2 of the camshaft, but the piston device will return to its initial position in proportion as hydraulic medium is discharged from the space 59.

Figure 5:
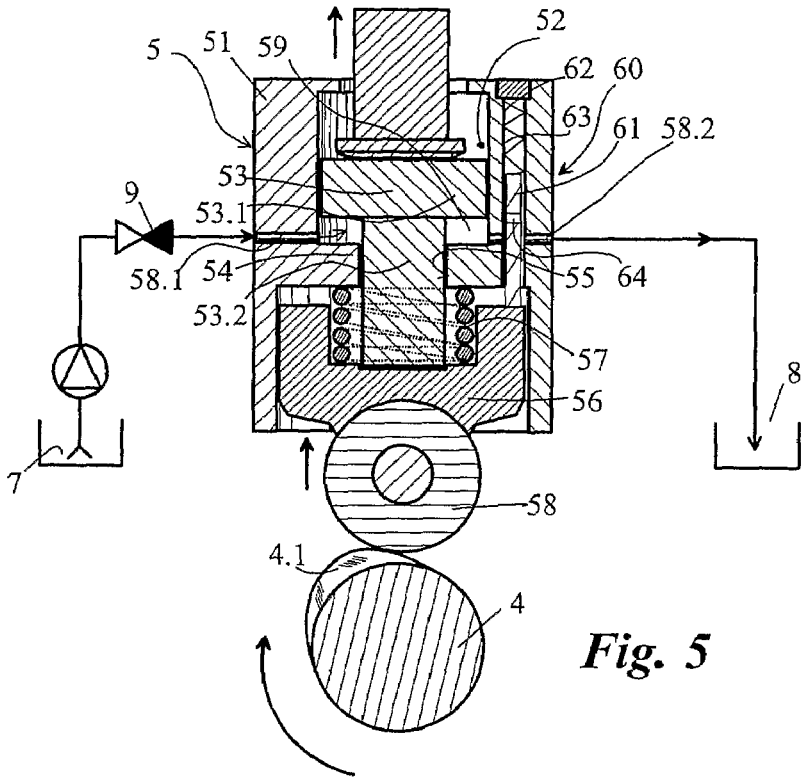
FIG. 5 shows a second control arrangement according to the invention during the opening phase.

FIG. 5 shows another embodiment according to the invention, the structure of which differs from the one shown in FIGS. 2-4 mainly in the fact that it is provided with a valve device 60 for controlling the discharge of hydraulic medium from the chamber space 59. The operational mode of the valve device is dependent on the position of the guide portion 56 with respect to the body part 51. The valve device 60 comprises a guide member 61, which is arranged in a space 62 in the body part. The space 62 is arranged in the body part so that it is parallel with the chamber 52. The guide member 61 in this embodiment is arranged to follow the movement of the guide portion 56 by means of compression force provided by a spring 63, whereby it in practise moves back and forth in the space together with the guide member according to the cam profile. A flow path 64 is arranged in the guide member 61 so that it in a certain position joins the discharge conduit 58.2 and opens a flow connection from the chamber space 59 to the return system 8 for hydraulic medium. In this embodiment the operation is such that the piston device 53 and also the valve start their movement with delay, whereas in the embodiment according to FIGS. 2-4 the movement starts immediately, even if the flow of the hydraulic medium out of the chamber space 59 slows down the movement.

Figure 6:
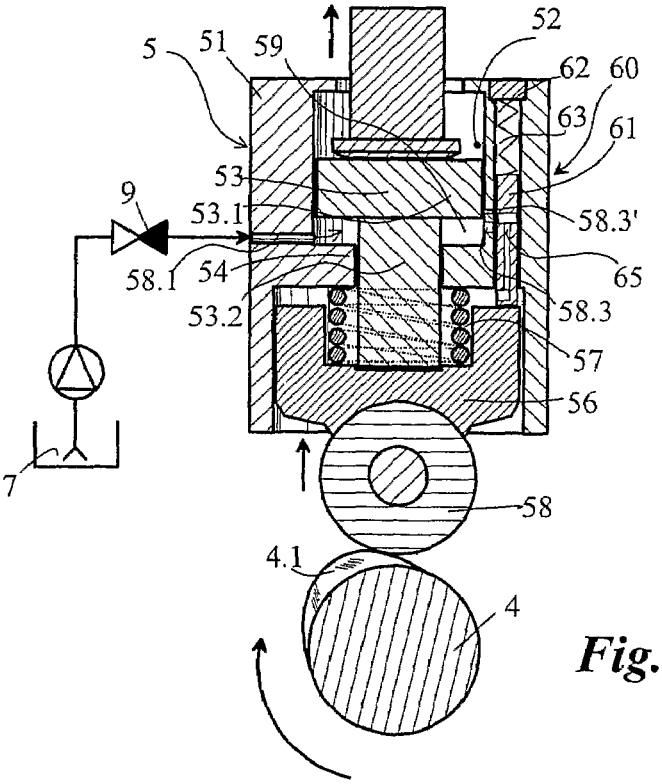
FIG. 6 shows a third control arrangement according to the invention during the opening phase.

The embodiment in FIG. 6 is otherwise similar to the one shown in FIG. 5, but it includes a discharge channel for hydraulic medium arranged in conjunction with the valve device 60, which channel opens to the chamber 52 on the other side of the partition wall 54. In FIG. 6 the guide member 61 of the valve device 60 comprises a discharge channel 65 for hydraulic medium extending to a distance from the first end of the guide member 61, whereby the channel thus opens to the other side of the chamber 52, where it opens to the outer surface of the guide member 61. The discharge channel 65 may be a hole or a bore, as shown in FIG. 6, but it may also be a groove or the like provided on the surface of the guide member. The body part 51 comprises here a discharge conduit 58.3, which connects the chamber space 59 and the space 62 in the body part, in which the guide member is adapted. The discharge channel 65 opens to the outer surface of the guide member at such a distance from the first end that a flow connection is formed the chamber space 59 via the discharge conduit 58.3 and the discharge channel 65 of the guide member to the other side of the partition wall 54 in the chamber at the latest when the guide portion 56 has reached its lowest position, i.e. it no longer moves towards the camshaft. The embodiments shown in FIGS. 5 and 6 may be varied further by making the throttling effect of the discharge channel dependent on the position of the guide member 61. It is possible to accomplish this by arranging discharge conduits 58.3, 58.3' of various sizes, for instance as shown in FIG. 6, whereby the flow conduit 58.3' that opens first has a smaller flow cross-sectional area than the actual discharge conduit 58.3.

Figure 7:
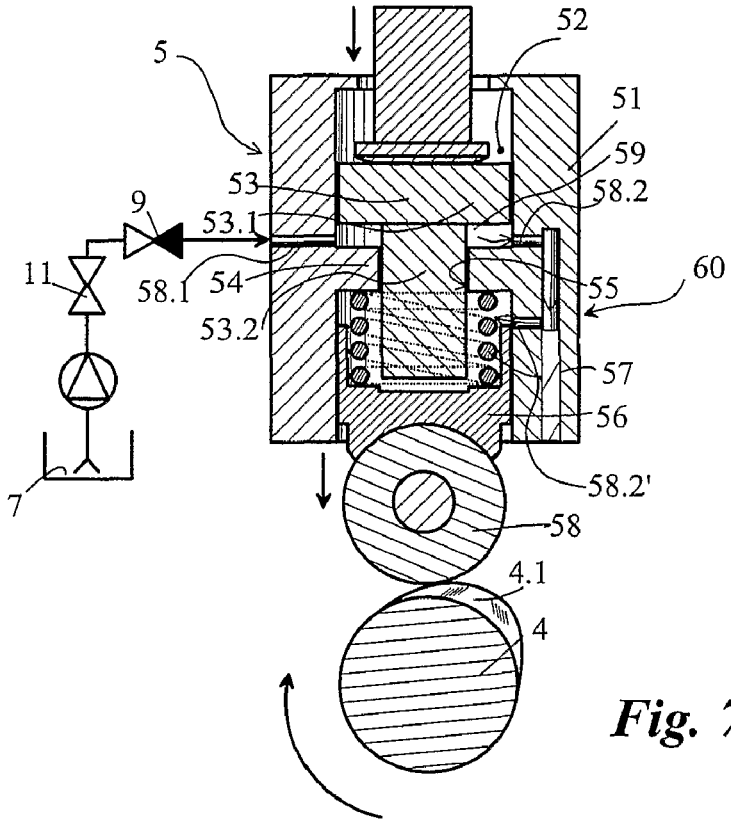
FIG. 7 shows a fourth control arrangement according to the invention during the closing phase.

FIG. 7 shows an embodiment, in which the discharge conduit 58.2 of the connection for hydraulic medium is in connection with the other side of the partition wall in the chamber 52 so that it opens to the space at a distance from the partition wall 54 so that the guide portion 56 covers the discharge conduit 58.2, while the control arrangement is in an unoperated state. The idea of this embodiment is that the direction of movement of the piston device 53 changes after the cam profile 4.1 has exceeded its peak, but primarily its movement does not start until the guide portion has passed by the opening 58.2'. By this embodiment it is thus possible to delay both the start of the downward movement of the piston device (in the figure) and thereafter to slow down the closing movement. The hydraulic medium flowing to the other side of the chamber may be utilised for lubricating the bearings of the roller 58.

Figure 8:
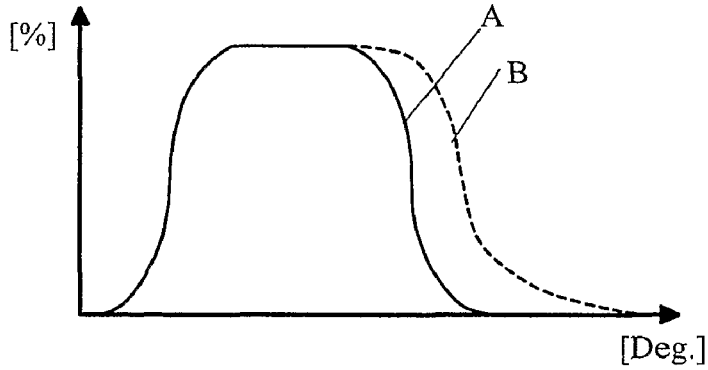
FIG. 8 shows a relative opening curve of the valve.

FIG. 8 shows the relative opening curve of the gas exchange valve as a function of the cam angle of the engine. Curve A shows a situation, in which hydraulic medium is not led at all to the chamber space 59, whereby the valve control is carried out merely determined by the cam profile. Curve B shows a situation, in which hydraulic medium is led to the chamber space 59, while the piston device moves in the opening direction of the valve, and its outflow from the chamber space is also throttled. According to the invention, it is thus possible to make the closing of the valve later than normally e.g. in different load situations of the engine.

The invention is not limited to the shown embodiments, but several variations are conceivable within the scope of the appended claims.

The invention claimed is:

1. A control arrangement for installation in a piston engine having a camshaft and a valve mechanism for controlling a gas exchange valve of the piston engine, said control arrangement comprising:

a body part defining a chamber into which at least one passage for conveying hydraulic medium opens, and a piston device disposed in the chamber, the piston device being in mechanical force transmission connection with the camshaft and the valve mechanism at least for opening the valve, the piston device being disposed between the camshaft and the valve mechanism with respect to mechanical force transmission from the camshaft to the valve mechanism, and wherein the passage for conveying hydraulic medium opens selectively into a space in the chamber for supplying hydraulic medium to said space, which space increases in volume as the piston device moves in an opening direction of the valve, whereby hydraulic medium flows into the space while the valve is being opened, and releasing of pressure in said space determines closing of the valve, whereby closing of the valve is delayed.

2. A control arrangement according to claim 1, wherein the body part includes a partition wall, ends of said space are defined by a first portion of the piston device and said partition wall, and sides of said space are defined by the body part and a second portion of the piston device.

3. A control arrangement according to claim 1, wherein the flow resistance of the hydraulic medium in the passage is lower while the hydraulic medium is flowing into the space, than the flow resistance while the hydraulic medium is flowing out of the space.

4. A control arrangement according to claim 3, comprising a throttle device for resisting flow of hydraulic medium out of said space.

5. A control arrangement according to claim 1, wherein said at least one passage comprises a feed conduit for supply of hydraulic medium to said space and a separate discharge conduit for discharging hydraulic medium from said space.

6. A control arrangement according to claim 5, comprising a flow throttling device for resisting flow of hydraulic medium through the discharge conduit.

7. A control arrangement according to claim 6, wherein the throttling device comprises a control device for throttling effect.

8. A control arrangement for installation in a piston engine having a camshaft and a valve mechanism for controlling a gas exchange valve of the piston engine, said control arrangement comprising:

a body part defining a chamber into which at least one passage for conveying hydraulic medium opens, and a piston device disposed in the chamber, the piston device being in mechanical force transmission connection with the camshaft and the valve mechanism at least for opening the valve, and wherein the passage for conveying hydraulic medium opens selectively into a space in the chamber for supplying hydraulic medium to said space, which space increases in volume as the piston device moves in an opening direction of the valve, whereby hydraulic medium flows into the space while the valve is being opened, and releasing of pressure in said space determines closing of the valve, whereby closing of the valve is delayed, and wherein the control arrangement further comprises a guide portion providing force transmission connection between the piston device and the camshaft, and a valve device controlling flow of hydraulic medium in a discharge conduit for discharging hydraulic medium from said space, and wherein operation of the valve device is dependent on the position of the guide portion relative to the body part.

9. A control arrangement according to claim 8, wherein the body part defines a cavity that extends parallel to the chamber and the valve device comprises a guide member that is disposed in said cavity and follows movement of said guide portion, said guide member being formed with an aperture that is selectively placed in alignment with the discharge conduit depending on the position of the guide portion relative to the body part.

10. A method of controlling a gas exchange valve in a piston engine having a camshaft and a valve mechanism for controlling the gas exchange valve, utilizing a control arrangement that is disposed between the camshaft and the valve mechanism with respect to mechanical force transmission from the camshaft to the valve mechanism and comprises a body part defining a space into which at least one passage for hydraulic medium opens and in which a piston device is arranged in mechanical force transmission connection with the camshaft and the valve mechanism at least for opening the valve, wherein the method comprises:

during an opening phase of the valve, allowing flow of hydraulic medium into said space, during a closing phase of the valve, restricting flow of hydraulic medium from said space, whereby closing of the valve is delayed, and throttling outflow of the hydraulic medium from said space when the hydraulic medium flows away from the control arrangement.

11. A piston engine comprising:

a gas exchange valve, a valve mechanism for controlling the valve, a camshaft in force transmission connection with the valve mechanism for selectively opening the valve and allowing the valve to close, and a control arrangement disposed operatively between the gas exchange valve and the camshaft and comprising a body part defining a chamber into which at least one passage for conveying hydraulic medium opens, and a piston device disposed in the chamber, the piston device being in mechanical force transmission connection with the camshaft and the valve mechanism at least for opening the valve, the piston device being disposed between the camshaft and the valve mechanism with respect to mechanical force transmission from the camshaft to the valve mechanism, and wherein the passage for conveying hydraulic medium opens selectively into a space in the chamber for supplying hydraulic medium to said space, which space increases in volume as the piston device moves in an opening direction of the valve, whereby hydraulic medium flows into the space while the valve is being opened, and the control arrangement further comprises a flow restricting element for restricting flow of hydraulic medium from said space whereby closing of the valve is delayed.

12. A piston engine according to claim 11, wherein the camshaft includes at least one profile element, the control arrangement comprises a guide element that engages the profile element and a spring effective between the body part and the guide element and urging the guide element into contact with the profile element, during an opening phase of the valve movement the guide element engages the piston device for moving the piston device in one direction relative to the body part, and during a closing phase of the valve movement the spring maintains the guide element in contact with the profile element while pressure of hydraulic fluid in said space resists movement of the piston device in an opposite direction relative to the body part, thereby delaying closing of the valve relative to movement of the guide element.

* * * * *